US005317303A

United States Patent [19]

Ross et al.

[11] Patent Number: 5,317,303

[45] Date of Patent: May 31, 1994

[54] BATTERYLESS SENSOR USED IN SECURITY APPLICATIONS

[75] Inventors: Gerald F. Ross, Longboat Key, Fla.; Richard M. Mara, Tewskbury; Kenneth W. Robbins, North Reading, both of Mass.; Robert J. Fontana, Rockville, Md.

[73] Assignees: Anro Engineering, Inc., Lexington, Mass.; Multispectral Solutions, Inc., Gaithersburg, Md.

[21] Appl. No.: 943,715

[22] Filed: Sep. 11, 1992

[51] Int. Cl.[5] ..... G08B 1/08; G08B 13/08

[52] U.S. Cl. ..... 340/539; 340/541; 340/545; 340/547; 340/549

[58] Field of Search ..... 340/539, 545, 547-549, 340/541, 540

[56] References Cited

U.S. PATENT DOCUMENTS

| | | | |
|---|---|---|---|
| 3,614,760 | 10/1971 | Zimmet | 340/539 |
| 3,696,359 | 10/1972 | Ross et al. | 340/547 |
| 3,772,669 | 11/1973 | Johnston et al. | 340/539 |
| 3,781,836 | 12/1973 | Kruper | 340/547 |
| 3,818,467 | 6/1974 | Willis | 340/539 |
| 3,827,038 | 7/1974 | Willis | 340/539 |
| 4,170,005 | 10/1979 | Duke | 340/547 |

*Primary Examiner*—Donnie L. Crosland
*Attorney, Agent, or Firm*—George Grayson

[57] ABSTRACT

A batteryless sensor includes a small and concealed permanent magnet motor which operates as a generator to convert rotational or translational energy to an ersatz Vcc transient power supply via a mechanical arrangement to radiate a coded VHF oscillator signal to a repeater or central processing unit located as far as one mile from the sensor. The receiver is able to monitor a multiplicity of sensor units over a given time period.

10 Claims, 5 Drawing Sheets

BATTERYLESS SENSOR USED IN SECURITY APPLICATIONS

DESCRIPTION OF THE PRIOR ART

1. Field of the Invention

This invention relates to a batteryless and unattended sensor which can be used in security system applications to, for example, determine remotely, the opening/closing of a door or a window without the use of hard wiring.

2. Description of Prior Art

The concept of a batteryless sensor was initially developed and patented for use as a vehicle traffic sensor [Reference 1]. The basic idea of the initial batteryless sensor is very simple. It consists of two opposing magnets mounted on iron pads and separated by a soft iron connecting rod. The rod serves as the core for a solenoid. When a ferromagnetic body, such as the under carriage of a vehicle, passes over the buried sensor a voltage, V, is produced by the solenoid in accordance with Faraday's Law. This law states that $$V = N\frac{d\phi}{dt},$$

where N is the number of turns and $d\phi$ the differential flux lines cut by the vehicle in a given time increment dt. The output voltage is an oscillatory transient of sufficient magnitude to power a VHF transmitter with an effective range of a few hundred feet. In the initial sensor, the radiated signal was produced when the amplitude of the signal was positive. The duration and amplitude of the oscillatory burst depended upon the speed and height of the vehicle. An oscillator using the output of the solenoid as an ersatz power supply ($V_{cc}$) radiated a VHF signal to a traffic pole a few hundred feet away and then to a CPU for processing data. To be effective, however, the vehicle must be in motion over the sensor.

In the same year, a second member of the class of batteryless sensors was developed to monitor tire pressure on large trucks based on the energy available from a rotating wheel [Reference 2]. Large trucks contain as many as 32 very expensive tires. Tires wear very quickly when tire pressure is too low. Here, the EMF, necessary to power an oscillator source, is generated by a resonant mechanical system excited by cyclic accelerations of the tire. A switch attached to the tire fill valve closes when the tire pressure is less than a preset threshold. The VHF oscillator signal is radiated to a display in the cab which indicates when tire pressure is too low. This is also a safety feature.

In 1984, a third member of the class of batteryless sensors was developed for use by the Immigration and Naturalization Service (INS), Department of Justice [Reference 3]. There, the task was to detect the presence of illegal immigrants crossing certain sections of our border with Mexico.

Since people are not ferromagnetic targets, a new concept was necessary. The advantages of a batteryless sensor, as before, are that there is no maintenance or battery replacement costs and the possibility of theft of the sensor itself is minimized; installation costs are minimal.

For the INS application, a piezoelectric energy source was chosen. After a considerable amount of experimentation, it was found that an ordinary push button igniter, similar to those in a commercial gas barbecue, could be mounted in a special set of hydraulic cylinders and used to generate sufficient energy to radiate a VHF signal to a remotely-located repeater. This Pascal cylinder arrangement is used to trade force for displacement, the equivalent of a mechanical transformer. Four pounds of force, as well as a ⅜ inch displacement, is required to trip the spring-loaded igniter. A human stepping on the sensor buried in sand four inches below the surface results in about 40 pounds of force applied to the igniter. The mechanical advantage provided by the Pascal cylinders is used to reduce the displacement in about the same proportion. These inexpensive sensors can be used to seed a preferred corridor of entry much like a mine field except here, a signal is radiated instead of an explosion.

The magnetic sensor placed in the roadway produces an EMF by changing the reluctance of the magnetic path. This, in turn, varies the flux lines passing through a solenoid generating the voltage required to power the VHF oscillator. The movement of the ferromagnetic automobile causes the generation action; the magnet and the solenoid are stationary.

In the batteryless low tire pressure sensor, the EMF is generated by a magnet mounted on a cantilever rod surrounded by a solenoid. Both the magnet and the solenoid rotate together with tire motion; only when there is acceleration (deceleration) is there a relative velocity between the magnet and the coil causing an EMF to be generated. This then powers a VHF oscillator which activates under low tire pressure.

For personnel detection, an EMF is generated by a piezoelectric transducer which is activated by an intruder's footprint. The format of this energy is a high voltage, short duration pulse (e.g., 30 kv and 50 μs, respectively). Here, converting the signal to a conventional $V_{cc}$ supply voltage with sufficient duration to operate a coded signal (e.g., 12 V and 20 ms respectively) is the task. The piezoelectric device and mounting structure remain fixed.

OBJECTS OF THE INVENTION

An object of the subject invention is to create a batteryless energy source for converting either a rotational or a translational motion applied to the sensor into electrical energy sufficient to power a VHF oscillator.

It is another object of the invention to make the duration of the ersatz $V_{cc}$ energy supply created by the motion sufficient to radiate a coded signal to a selective receiver located typically up to one mile distant from the sensor.

It is a further object to require no wiring to or from the sensor, and that the installation be covert in the sense that its presence is not obvious under general inspection.

SUMMARY OF THE INVENTION

The above objectives and advantages are achieved in a preferred embodiment of the present invention. A small and concealed permanent magnet motor operated as a generator and when placed, in one example, in a door jamb is used to convert the rotational energy available from opening/closing a door or, in another example, the translational energy from opening/closing a window to an ersatz $V_{cc}$ transient power supply via a pulley and spring arrangement; the regulated 10 volt supply has a duration of about 150 ms. The duration of the power supply is sufficient to radiate a coded VHF oscillator signal to a repeater or central processing unit located as far as one mile from the sensor. The receiver is able to interrogate a multiplicity of sensor units over a given time period. It is shown how the covertness of the sensor can be further improved by using opposing magnets mounted both in the door and jamb.

DESCRIPTION OF THE PREFERRED EMBODIMENT

1. The Energy Source

In the batteryless sensor described in the subject invention, the intruder spins the armature of a small permanent magnet dc motor and gear train. Either the field or the magnets are moved relative to each other by the motion of the intrusion that generates the EMF. Translation energy here is converted to rotary motion and a pulley and a gear reduction scheme is used to provide the proper duration signal.

A dc motor, acting as a generator, converts motion to a transient electrical power supply. For example, the rotational energy of a door closure/opening motion is converted to the transient electrical power supply. In another example, the linear motion of a double hung window being opened is converted to the transient electrical power supply. The gear train spins the motor, which acts as the generator, at a high speed for a small linear displacement of a rod located in the frame of the door or window. One approach is to use a rack and pinion gear arrangement to convert the linear translation of a rod mounted in the door frame or window into a momentary rotational movement of the generator shaft. This was replaced in later models by a simple pulley and spring arrangement as the preferred mounting arrangement for the sensor. An analysis of the door/rod/pulley and gear train requirements will follow.

Figure 1B:
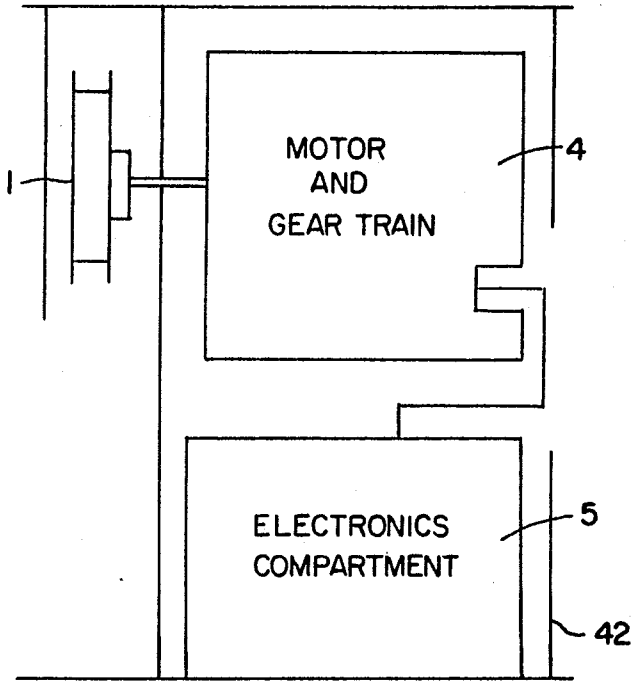
FIG. 1*b* shows a front view of the batteryless sensor.
Figure 1A:
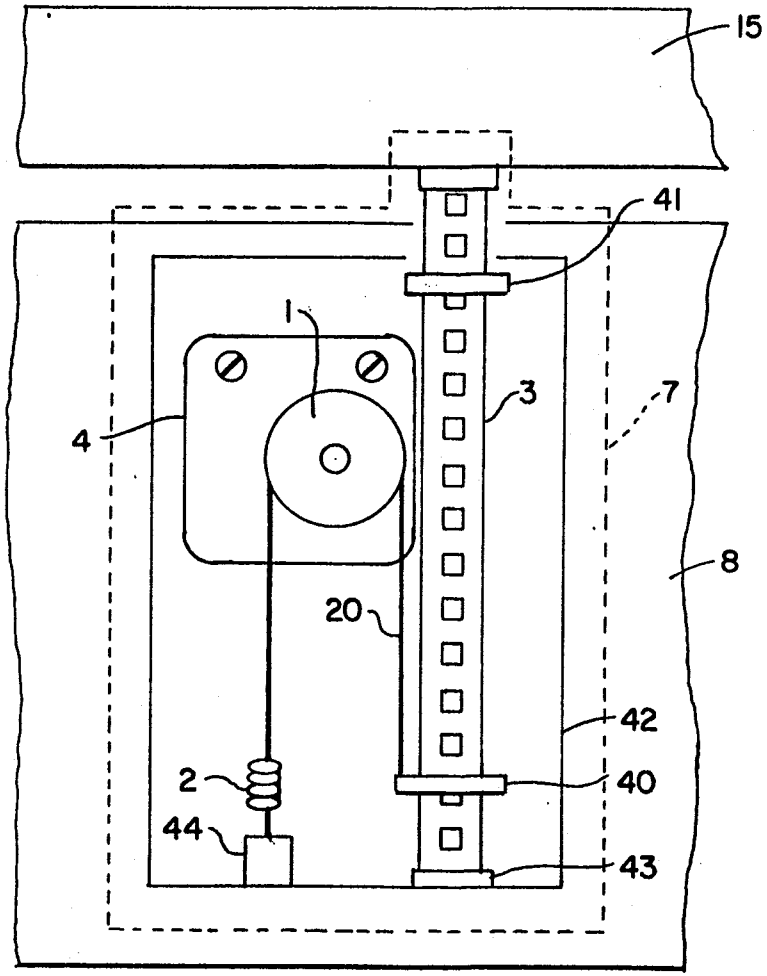
FIG. 1*a* shows a side view of a batteryless sensor.

A typical example showing the invention is shown in FIGS. 1*a* and 1*b*. Referring to FIG. 1*a*, a batteryless sensor 7 is encased in a door jamb 8. When a plunger rod 3 is pushed in by the closing of a door 15, a timing belt 20 attached to the rod 3 by a collar 40 turns a pulley 1 which rotates a motor/generator 4. A spring 2 applies the proper tension to belt 20 to reset the rod 3 when the door 15 opens, again turning pulley 1 and rotating motor/generator 4 in the opposite direction. A stop collar 41 fastened to rod 3 is stopped by an inner surface of a container 42 to limit the motion of rod 3. A rubber grommet 43 cushions the rod 3 at the bottom. One end of spring 2 is anchored to a block 44, which is fastened to container 42.

In the front view of the sensor 7 shown in FIG. 1*b*, the motor/generator and gear train assembly 4 and pulley 1 can be seen in conjunction with transmitter electronics 5 described in the next section. Subminiature componentry for sensor 7 is now commercially available to fit most window and door frames.

One embodiment of the subject invention uses a motor/generator and associated gear train 4 manufactured by Buehler Products, Inc., Raleigh, N.C., and identified as 18 V dc, part #1.61.01.347-5 068. The gear train accompanying the motor/generator 4 requires modification for this application. A number of intermediate spur gears are removed. A spacer is added so that the drive gear directly drives the gear that was previously at the end of the chain. In this manner, an approximately one inch displacement of the rod 3 mounted in the door jamb 8 turns the pulley 1 about ⅛ turn at a sufficient speed to generate about 10 volts across a 1k ohm load. With capacitor filtering, a pulse duration of 150 milliseconds (ms) is produced.

Figure 3:
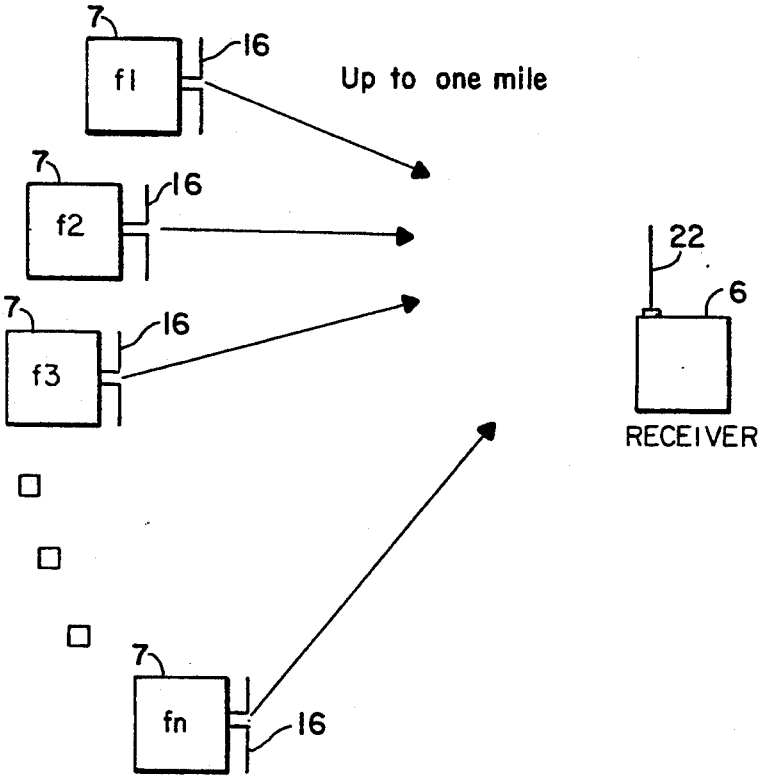
FIG. 3 shows an array of coded sensors and a central receiver.

The total cost of all the components, including the motor/generator and gear train 4 and the electronics 5 is in the order of tens of dollars for the batteryless sensor 7; this does not include the cost of receiver 6 of FIG. 3, which is estimated in the range of hundreds of dollars.

2. The Integrated Sensor

Figure 2:
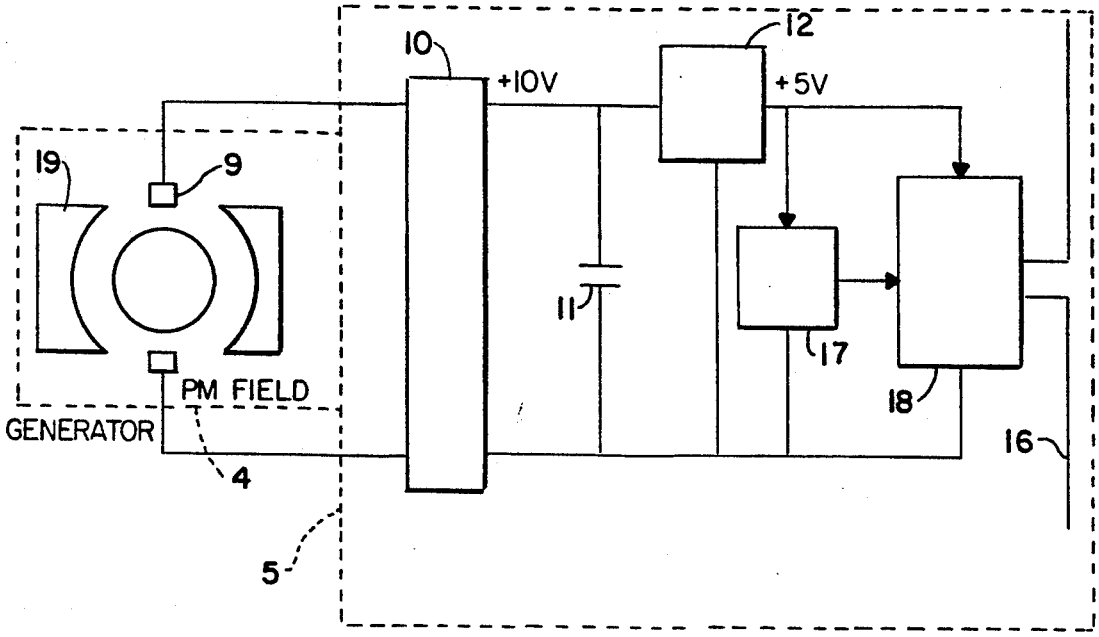
FIG. 2 shows an electronic block diagram of the preferred embodiment of the invention.

An electronic block diagram of the preferred embodiment of the energy source 5 is shown in FIG. 2. Rod 3, belt 20 and pulley 1 turn the generator/gear train 4 shaft by making physical contact with the door 15 as shown in FIG. 1*a*. The resulting output of generator brushes 9, permanent magnet (PM) field 19 is applied to a DF02M, 1 ampere, 200-volt full-wave bridge rectifier 10 producing an unregulated 10 volt peak signal. A 100 μfd, 25 volt filter capacitor 11 and a 5 volt type 1078L05 regulator 12 provides an Ecc +5 volt supply, which is constant during the 150 ms pulse burst of VHF energy. The 5 volt $V_{cc}$ supply is connected to both a tone generator 17 (MX503 or 258TC) and a modulator and VHF oscillator 18 which feeds an essentially resonant dipole 16 (i.e., depending on length constraints in the door application). The signal radiated by the MC2833 oscillator chip 18 is set at 49.845 MHz and receives tones from tone generator 17 from 600 to 2,295 Hz. Four different tones were selected for experimentation and monitored by receiver 6. The MC2833 oscillator chip 18 is described on page 2–20 of the Motorola Telecommunications Catalogue, DL136 Revision 2, 1989.

In FIG. 2, the tone generator 17 supplies a sinusoidal tone frequency depending upon the digital code selected, as shown in Table I, as set by small switches $D_0$ through $D_3$. One such switch setting is assigned to each batteryless/window sensor 7. In FIG. 3, a central receiver 6 distal to the sensors 7 receives the radiated signals.

TABLE I

TONE MODULATOR TABLE.

| Input Tone Frequencies ($f_0$ in Hz)* MX013QA | Binary Coded Inputs $D_3$ | $D_2$ | $D_1$ | $D_0$ |
|---|---|---|---|---|
| 600 | 0 | 0 | 0 | 0 |
| 741 | 0 | 0 | 0 | 1 |
| 882 | 0 | 0 | 1 | 0 |
| 1023 | 0 | 0 | 1 | 1 |
| 1164 | 0 | 1 | 0 | 0 |
| 1305 | 0 | 1 | 0 | 1 |
| 1446 | 0 | 1 | 1 | 0 |
| 1587 | 0 | 1 | 1 | 1 |
| 1728 | 1 | 0 | 0 | 0 |
| 1869 | 1 | 0 | 0 | 1 |

TABLE I-continued

| TONE MODULATOR TABLE. | | | | |
|---|---|---|---|---|
| Input Tone Frequencies ($f_0$ in Hz)* MX013QA | Binary Coded Inputs | | | |
| | $D_3$ | $D_2$ | $D_1$ | $D_0$ |
| 2151 | 1 | 0 | 1 | 0 |
| 2435 | 1 | 0 | 1 | 1 |
| 2007 | 1 | 1 | 0 | 0 |
| 2295 | 1 | 1 | 0 | 1 |
| 459 | 1 | 1 | 1 | 0 |
| NOTONE | 1 | 1 | 1 | 1 |

*Tolerance, ±20 Hz (Minimum)

The experimentally-measured current drains for the various components are as shown in Table II.

TABLE II

| CURRENT DRAIN @ 5 VOLTS REGULATED. | | |
|---|---|---|
| Component # | Component Type | Current (ma) |
| 17 | MX503 | 3 |
| 12 | 78L05 | 0.5 |
| 18 | MC2833 | 3.0 |

The total current drain of the sensor, when activated, is 6.5 ma, corresponding to an actual load of 770 ohms, as compared to our original value of 750 ohms used in the initial testing of the $V_{cc}$ source. The chips for the RF modulator/oscillator 18 and tone generator 17 were selected to coordinate with the receiver 6 design. The frequency deviation of the FM transmission was measured to be 2500 Mz.

Figure 4:
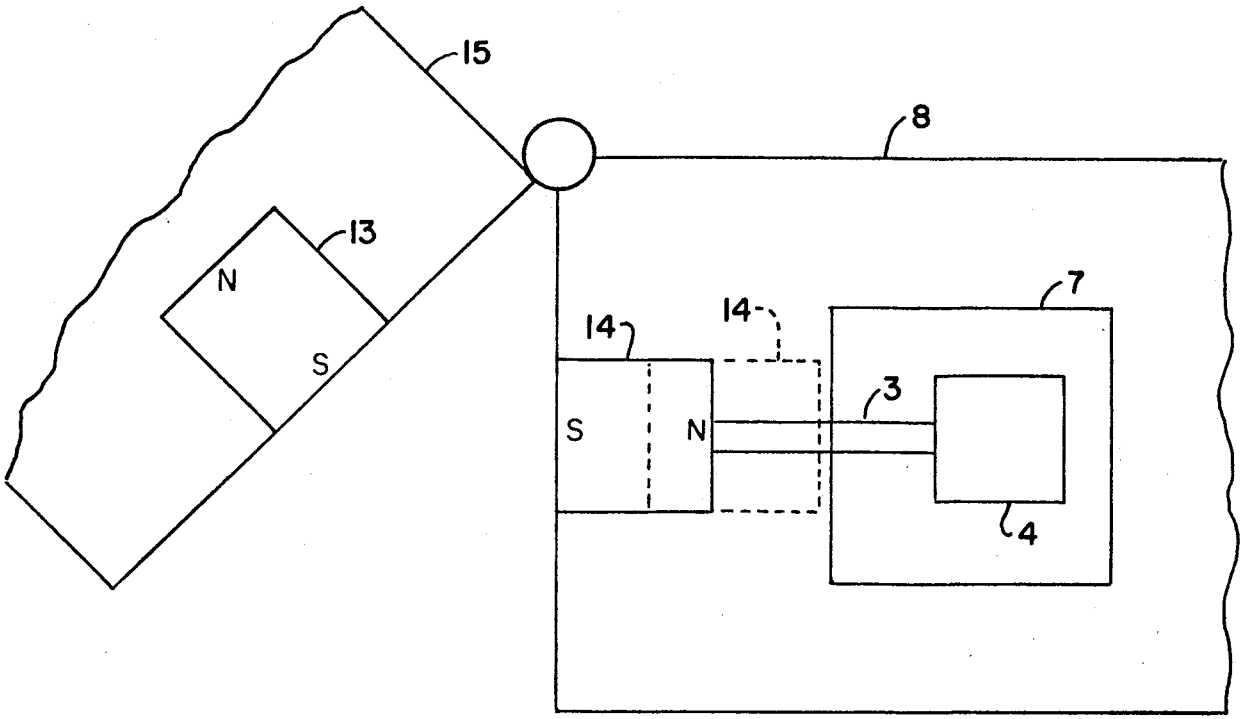
FIG. 4 shows a covert permanent magnet approach for driving the permanent magnet generator of the batteryless sensor.

In FIG. 4 a more covert application suggests the use of two opposing magnets 13 and 14 in the door 15 and the door jamb 8 respectively. Then when the door 15 closes, the opposing magnets 13 and 14 would cause the rod 3 connected to one of the magnets 14 to drive the gear train 4 and, in turn, the generator 4 of sensor 7. The selection of magnets 13 and 14 and the cosmetic design of the door 15 and jamb 8 to facilitate this concept would be used where covertness is important.

FIG. 3 shows one receiver 6 monitoring a large number, f1 through fn, of coded sensors 7. The dipole 16 transmits the coded rf signals to antenna 22 of receiver 6.

3. Primary Power Requirements

It can be shown that to achieve a range of one mile requires an effective radiated power of about 10 mW. Assuming the gain of the non-resonant dipole 16 of FIG. 2 (because of the extended length required) to be about unity, the dc primary power required for a measured 40 percent oscillator efficiency is about 25 mW. For a $V_{cc}$ of 5 volts, this corresponds to an equivalent load resistance of $$R_L = \frac{(V_{cc})^2}{\text{Primary Power}} = \frac{25}{25 \times 10^{-3}} \sim 1\text{k}\Omega$$

Allowing for some power to operate the tone generator used for coding and modulator/transmitter 18, a RL=750 ohms was used for initial testing. For a rod 3 having a length of 1 inch and a 120 degree rotation of the shaft of the generator 4 in a half second, a signal duration of 150 ms is radiated; a minimum signal duration of 20 ms is required for successful detection.

4. The Receiver

Figure 5:
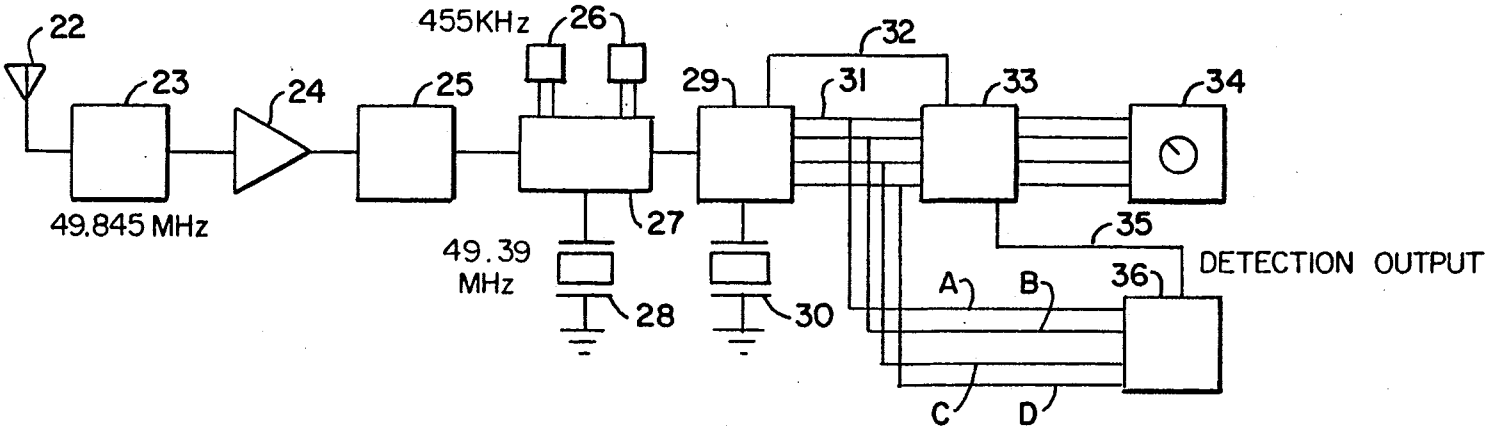
FIG. 5 shows a micropower receiver block diagram.

A block diagram of the receiver 6 is provided in FIG. 5. The radiated VHF signal from the batteryless sensor 7 is received by antenna 22 and filtered by input bandpass filter 23. After amplification in low noise RF amplifier 24, the signal is further filtered by bandpass filter 25 in order to reduce the possibility of adjacent channel interference.

The filtered RF signal is then fed to a micropower RM receiver chip 27 (Motorola MC 3367) which consists of an internal downconverter (controlled by local oscillator crystal 28), IF amplifier, quadrature detector and lower power audio stages. Filtering is accomplished at the intermediate frequency (IF) of 456 kHz through the use of external resonators 26.

The audio output from the micropower receiver 27 is then passed to a tone decoder 29, an MX-COM MX-013 MetroPage TM decoder chip. A reference frequency for the tone decoder is generated by an internal oscillator controlled by external ceramic resonator 30. Upon receiving a narrowband FM, RF emission having the correct tone (FM modulation frequency), the decoder output 31 contains a four-bit digital word containing the ID of the signal, and Data Valid line 32 goes high to indicate that a valid tone has been received.

Hexadecimal switch 34 is used to select one of the 16 possible tone frequencies. If the output 31 from tone detector 29 matches the setting of switch 34, a logical one Detection Output signal 35 is generated by the comparator 33 to activate a monitor 36.

Receiver 6 power is obtained from a set of three (3) D-size lithium batteries (not shown). The entire receiver 6, as described above, draws approximately 2 mA at 3.6 Volts.

The batteryless sensor 7 being used operates on a spring-loaded pulley system which produces a voltage signal used to power a transmitter chip. It is important to determine the minimum rotational (angular) velocity required to cause the generator to produce some minimum supply voltage $V_S$.

Figure 6:
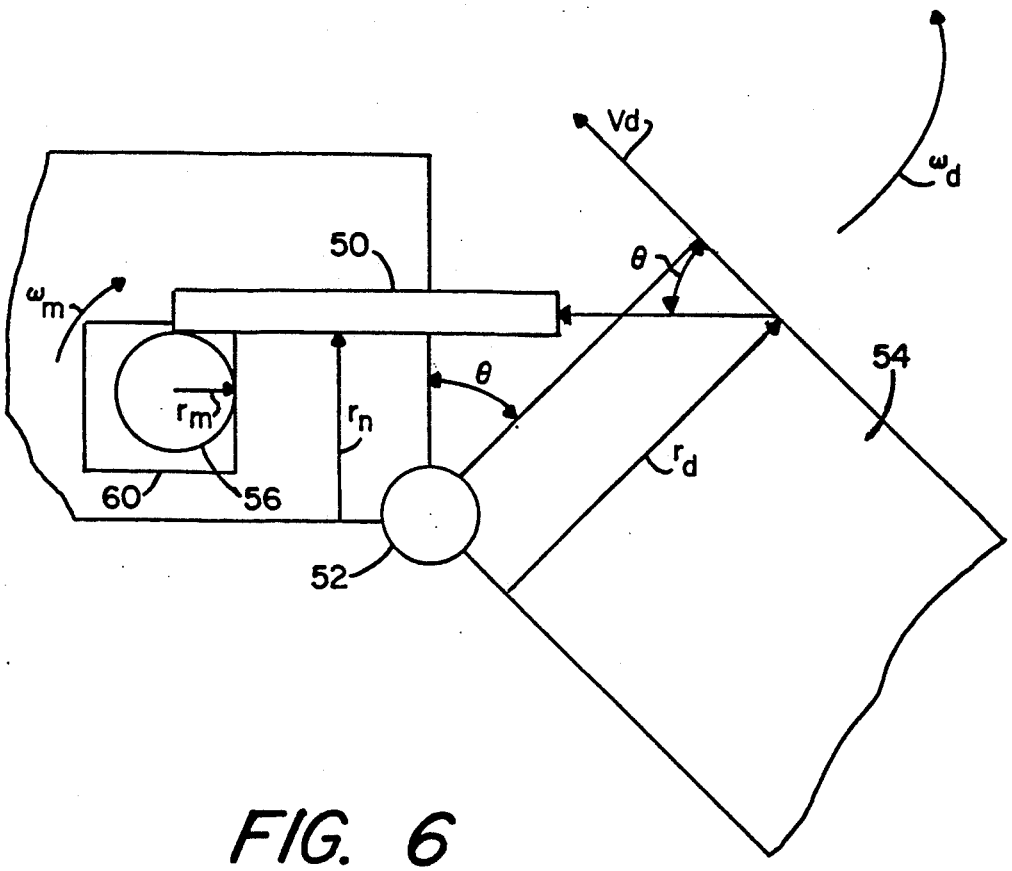
FIG. 6 is a vector representation of physical variables.

In FIG. 6, it can be seen that an applied rotational velocity, $\omega_d$, initiated by a door 54 closure/opening motion will translate to a certain related tangential velocity $V_m$ as follows:

$$V_d = \omega_d r_d$$

$$V_m = V_d \cos\theta = \omega_d r_d \cos\theta \quad (1)$$

At first it would appear that a generator's 60 velocity depends only on the angle $\theta$ of the door 54 opening. However, upon further examination, it can be shown that $r_d$, the width of door 54, also varies with $\theta$ in a way that diminishes the dependence of the velocity on the angle of the door 54 opening. That is, since:

$$r_d = r_n \sec\theta, \quad (2)$$

it follows from (1) that $$v_m = \omega_d r_n \sec\theta \cos\theta = \omega_d r_n. \quad (3)$$

Therefore, the relationship between the generator pulley's 56 rotational velocity ($\omega_m$) and the door's rotational velocity, $\omega_d$, is given by:

$$V_m = \omega_m r_m. \quad (4)$$

Then, by setting (3) equal to (4), the following ratio of rotational velocities is obtained:

$$\omega_m/\omega_d = r_n/r_m. \quad (5)$$

Figure 7:
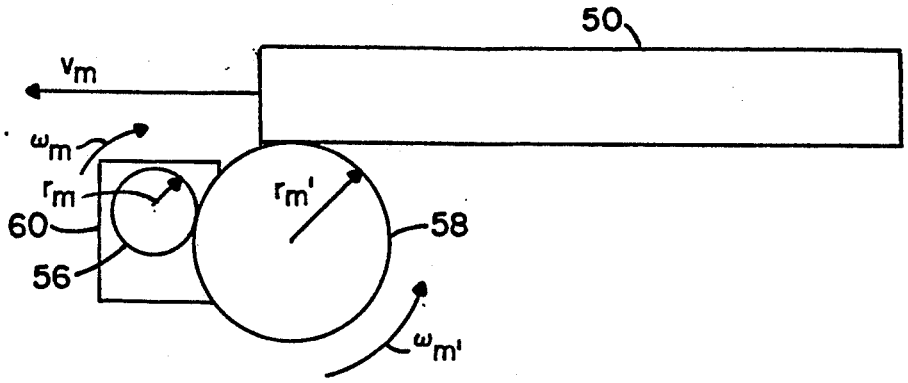
FIG. 7 shows a step up gear arrangement.

This indicates that the generator's 60 velocity can be varied by changing the ratio of the pulley 56 and hinge 52 to rod and belt 50 radii. If enough rotational motion from the generator pulley 56 cannot be achieved, another step-up gear 58 can be added between the generator pulley 56 and rod and belt 50, as shown in FIG. 7. From the following relationships, the improvement that the step-up gear 58 will contribute can be found to be:

$$V_m = \omega_m' r_m' = \omega_m r_m, \quad (6)$$

and therefore, $$\omega_m/\omega_m' = r_m'/r_m. \quad (7)$$

Equation (7) indicates that for a given $V_m$, the rotational speed of the generator 60 can be increased directly by a factor of the ratio of the radii of the two gears 56 and 58.

While the invention has been shown and described with reference to the preferred embodiment thereof, it will be understood by those skilled in the art that the above and other changes in form and detail may be made therein without out departing from the spirit and scope of the invention.

We claim:

1. A system including a number of batteryless sensors and a single receiver for detecting an intrusion at any one of said sensors, each of said sensors comprises:

a sensor enclosure having an opening at atop end and a spring anchor at a bottom end;

a rod positioned parallel to an intersection of two sides of said enclosure and having a top end protruding through said opening;

a spring connected to said spring anchor;

a pulley;

a toothed belt having one end connected to said spring and another end connected to said rod at a bottom end in such a manner as to be wrapped around said pulley for a predetermined angle, said rod protruding through said opening a first predetermined distance under tension from said spring when said rod is in a first position, and said rod protruding through said opening a second predetermined distance under tension from said spring when said rod is being held in second position by a protected body, generator means having said pulley positioned so that rotation of said pulley by said belt when said rod moves between said first position and said second position, and between said second position and said first position, generates a predetermined voltage;

electronic means coupled to said generator means and responsive to said predetermined voltage for generating a coded rf signal identifying said sensor;

said single receiver responsive to said coded rf signal from said any one of said sensors for signaling that said intrusion occurred and identifying a site of said intrusion.

2. The batteryless sensor of claim 1 wherein said generator means comprises:

a gear train being driven by said pulley for amplifying the rotational speed of said pulley, and a motor/generator coupled to an output shaft of said gear train for generating said predetermined voltage.

3. The batteryless sensor of claim 2 wherein said electronic means comprises:

a full-wave rectifier for receiving said predetermined voltage and producing an unregulated peak signal;

a regulator for receiving said unregulated peak signal and producing a constant voltage for a predetermined time;

a tone generator for receiving said constant voltage and producing a unique frequency signal to identify said sensor;

an oscillator set for a fixed frequency is modified by said unique frequency to produce said coded rf signal when receiving said constant voltage; and a dipole for sending out said coded rf signal to said receiver.

4. A system for detecting an opening or a closing of a number of doors at one or more locations, each of said doors having a covert batteryless sensor, said system including a single receiver for indicating an opening or a closing of any one of said doors, each of said sensors comprises:

a first magnet immovably mounted in a hinged side door edge with one pole face of said magnet flush with said door edge;

a second magnet slideably mounted in a door jamb with an opposing pole face parallel to, facing and axial to said one pole face and flush with said door jamb when said door is ajar;

plunger rod means axially fixed to said second magnet to allow said second magnet to be magnetically repelled by said first magnet so as to move axially a predetermined distance away from said first magnet when said door is closed, and move axially said predetermined distance towards said first magnet when said door is opened, wherein said plunger rod means includes:

a sensor enclosure having an opening at a top end;

a rod positioned parallel to an intersection of two sides of said enclosure and having a top end protruding through said opening and securely fastened to said second magnet, said rod protruding through said opening so as to position said opposing pole face of said second magnet flush with said door jamb when said door is ajar, and to move a predetermined distance when said door is closed and said second magnet is repelled;

generator means coupled to said plunger rod means including means for following a movement of said predetermined distance, and including means for generating a coded rf signal upon detecting said movement; and said single receiver being responsive to said coded rf signal from said any one of said sensors for signaling that said intrusion occurred and identifying a site of said intrusion.

5. The sensor of claim 4 wherein said follower means comprises:

said enclosure having a spring anchor fastened at a bottom end;

a spring connected to said spring anchor;

a pulley;

a toothed belt having one end connected to said spring and another end connected to said rod at a bottom end in such a manner as to be wrapped around said pulley for a predetermined angle so as to provide tension to said rod to maintain said opposing pole face of said second magnet flush to said door jamb when said door is ajar, said pulley translating a linear distance traveled by said rod to a rotational angle when said door is opened and said second magnet is repelled.

6. The sensor of claim 5 wherein said generating means comprises:

a gear train being drive by said pulley for amplifying the rotational speed of said pulley as said pulley rotates through said angle, and a motor/generator coupled to an output shaft of said gear train for generating said predetermined voltage.

7. A system including a number of batteryless sensors and a single receiver for detecting an intrusion at any one of said sensors, each of said sensors comprises:

means for positioning a sensor in a location whereby said intrusion would effect a physical displacement of a medium;

mechanical means for sensing said physical displacement, said mechanical means including:

a sensor enclosure having an opening at a top end;

a rod positioned parallel to an intersection of two sides of said enclosure and having a top end protruding through said opening to a first position, and said rod protruding through said opening to a second position, when said rod is being held by a protected body;

generator means coupled to said mechanical means for converting said sensing of said physical displacement to a predetermined voltage;

electronic means coupled to said generator means and responsive to said predetermined voltage for generating a coded rf signal identifying said sensor; said single receiver responsive to said coded rf signal from said any one of said sensors for signaling that said intrusion occurred and identifying a site of said intrusion.

8. The sensor of claim 7 wherein said generator means comprises:

said enclosure having a spring anchor fastened at a bottom end;

a spring connected to said spring anchor;

a pulley;

a toothed belt having one end connected to said spring and another end connected to said rod at a bottom end in such a manner as to be wrapped around said pulley for a predetermined angle so as to provide tension to said rod to maintain said rod in said first position, said pulley translating a linear distance traveled by said rod from said first position to said second position to a rotational angle;

a gear train being driven by said pulley for amplifying the rotational speed of said pulley as said pulley rotates through said angle, and a motor/generator coupled to an output shaft of said gear train for generating said predetermined voltage.

9. A system for detecting an opening or a closing of a number of windows at one or more locations, each of said windows having a covert batteryless sensor, said system including a single receiver for indicating an opening or a closing of any one of said windows, each of said sensors comprises:

a first magnet immovable mounted in a window frame with one pole face of said magnet flush to said window frame edge;

a second magnet slideably mounted in a corresponding side of said window with its opposing pole face parallel to, facing and axial to said one pole face;

spring means axially fixed to said second magnet to allow said opposing pole face to move axially a predetermined distance toward said one pole face when said window is in a first position, and move axially said predetermined distance away from said one pole face when said window is in a second position, wherein said spring means includes a rod axially fastened to said second magnet at a top end and a toothed belt having one end connected to a spring and another end connected to said rod at a bottom end in such a manner as to be wrapped around a pulley for a predetermined angle so as to provide tension to said rod to maintain said opposing pole face of said second magnet flush to said door jamb when said door is ajar, said pulley translating a linear distance traveled by said rod to a rotational angle when said door is opened and said second magnet is repelled;

generator means including means for following a movement of said second magnet said predetermined distance, and including means for generating a coded rf signal upon detecting said movement; and said receiver being responsive to said coded rf signal from said any one of said sensors for signaling that said intrusion occurred and identifying a site of said intrusion.

10. A method of detecting an intrusion by means of a batteryless sensor including the steps of:

A. Installing the sensor at a location where the intrusion would generate a mechanical displacement;

B. Mechanically sensing the mechanical displacement as a movement in a straight line;

C. Converting said straight line movement to a rotational movement;

D. Mechanically speeding up the rotational movement;

E. Generating an output voltage;

F. Converting the output voltage to a coded rf signal;

G. Sensing the coded rf signal over the air;

H. Receiving the coded rf signal at a remote site; and

I. Identifying the intrusion source.

* * * * *